US006348438B1

(12) United States Patent
Le Coent et al.

(10) Patent No.: US 6,348,438 B1
(45) Date of Patent: Feb. 19, 2002

(54) PRODUCTION OF HIGH BN ALKALINE EARTH METAL SINGLE-AROMATIC RING HYDROCARBYL SALICYLATE-CARBOXYLATE

(75) Inventors: Jean-Louis Marie Le Coent, LeHavre (FR); Curt B. Campbell, Hercules, CA (US); Thierry Triconnet, Saint-Romain de Colbosc (FR)

(73) Assignees: Chevron Oronite S.A. (FR); Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 09/325,209

(22) Filed: Jun. 3, 1999

(51) Int. Cl.[7] ..... C10M 159/20
(52) U.S. Cl. ..... 508/332; 508/331; 508/460
(58) Field of Search ..... 508/460, 331, 508/332

(56) References Cited

U.S. PATENT DOCUMENTS

| | | | | | |
|---|---|---|---|---|---|
| 3,036,971 | A | | 5/1962 | Otto | 252/42.7 |
| 3,493,516 | A | | 2/1970 | Allphin et al. | 252/33.3 |
| 5,030,687 | A | * | 7/1991 | Leone | 508/460 |
| 5,069,804 | A | | 12/1991 | Marsh et al. | 252/42.7 |
| 5,415,792 | A | * | 5/1995 | Campbell | 508/460 |
| 5,433,871 | A | | 7/1995 | O'Connor et al. | 252/18 |
| 5,602,084 | A | * | 2/1997 | Moreton | 508/391 |
| 5,652,203 | A | * | 7/1997 | Asamori et al. | 508/460 |
| 5,714,443 | A | | 2/1998 | Cane et al. | 508/460 |
| 5,716,914 | A | | 2/1998 | Cane et al. | 508/460 |
| 5,895,777 | A | * | 4/1999 | Ueda et al. | 508/331 |
| 6,147,035 | A | * | 11/2000 | Sougawa et al. | 508/192 |
| 6,153,565 | A | * | 11/2000 | Skinner et al. | 508/391 |
| 6,162,770 | A | * | 12/2000 | LeCoent et al. | 508/460 |

FOREIGN PATENT DOCUMENTS

| | | | |
|---|---|---|---|
| EP | 0 094 814 | 4/1989 | C10M/129/40 |
| EP | 0 351 052 | 5/1994 | C10M/159/22 |
| EP | 0 385 616 | 6/1994 | C10M/159/22 |
| EP | 0 351 053 | 2/1995 | C10M/159/24 |
| EP | 0 675 191 A2 | 10/1995 | C10L/1/18 |
| EP | 0 675 191 A3 | 10/1995 | C10L/1/18 |
| EP | 0 347 104 | 12/1997 | C10M/159/12 |
| EP | 0 347 103 | 1/1998 | C10M/159/20 |
| EP | 98 40 2228 | 1/1999 | C10M/159/22 |
| FR | 1 563 557 | 4/1969 | |
| FR | 2 625 220 | 6/1989 | C10M/159/22 |
| WO | 88/03944 | 6/1988 | C10M/159/22 |
| WO | 88/03945 | 6/1988 | C10M/159/22 |
| WO | 95/25155 | 9/1995 | C10M/159/22 |

* cited by examiner

*Primary Examiner*—Ellen M. McAvoy
(74) *Attorney, Agent, or Firm*—Linda A. Stokley; Richard J. Sheridan; Claude J. Caroli

(57) ABSTRACT

An overbased alkaline earth metal single-aromatic ring hydrocarbyl salicylate-carboxylate is produced by overbasing a mixture of a single-aromatic ring hydrocarbyl salicylate, at least one solvent, a metal hydroxide, and an alkyl polyhydric alcohol alkaline earth metal hydroxide, by contacting that mixture with carbon dioxide under overbasing reaction conditions. The alkyl group of the alkyl polyhydric alcohol has from one to five carbon atoms. The overbased metal single-aromatic ring hydrocarbyl salicylate is treated, before, during, or subsequent to overbasing, with a long-chain carboxylic acid to form a single-aromatic ring hydrocarbyl salicylate-carboxylate.

30 Claims, No Drawings

PRODUCTION OF HIGH BN ALKALINE EARTH METAL SINGLE-AROMATIC RING HYDROCARBYL SALICYLATE-CARBOXYLATE

The present invention relates to the production of highly overbased, alkaline earth metal, single-aromatic ring, hydrocarbyl salicylate-carboxylates. Specifically, it relates to a highly overbased calcium, single-aromatic ring, alkylsalicylate-stearate.

BACKGROUND OF THE INVENTION

The preparation of phenate-stearates is well known in the art.

European Patent Application No. 0,094,814 A2 teaches improving the stability of an overbased phenate by treating the phenate with a carboxylic acid having a $C_{10}$ to $C_{24}$ unbranched segment, such as stearic acid.

PCT Patent Applications WO 88/03944 and 88/03945 teach an overbased phenate having a TBN of more than 300. This high TBN is achieved by using an additional component: either a carboxylic acid, such as stearic acid, or a di- or poly carboxylic acid having from 36 to 100 carbon atoms, or an anhydride, acid chloride, or ester thereof.

The preparation of alkylsalicylates is also well known in the art.

U.S. Pat. No. 3,036,971 discloses preparing detergent dispersant additives based on sulfurized alkylphenates of high basicity alkaline earth metals. These additives are prepared by sulfurization of an alkylphenol, neutralization of the sulfurized alkylphenol with an alkaline earth metal base, then super-alkalization by carbonation of the alkaline earth metal base dispersed in the sulfurized alkylphenate.

French patent 1,563,557 discloses detergent additives based on sulfurized calcium alkylsalicylates. These additives are prepared by carboxylation of a potassium alkylphenate, exchange with calcium chloride, then sulfurization of the calcium alkylsalicylate obtained with sulfur in the presence of lime, a carboxylic acid and an alkylene glycol or alkyl ether of alkylene glycol.

French patent application 2,625,220 discloses superalkalized detergent-dispersant additives based on alkylphenates and alkylsalicylates. These additives are prepared by neutralization of an alkylphenol with an alkaline earth metal base in the presence of an acid and a solvent, distillation of the solvent, carboxylation, sulfurization and superalkalization by sulfur and an alkaline earth metal base in the presence of glycol and solvent, followed by carbonation and filtration.

PCT patent application PCT/FR95/00299 discloses a process that is able to improve substantially the performance of these additives, particularly in the tests relating to foaming, compatibility and dispersion in a new oil, and in the tests of stability towards hydrolysis. This process comprises neutralization with alkaline earth metal base of a mixture of linear and branched alkylphenols in the presence of a carboxylic acid, carboxylation by the action of carbon dioxide of the alkylphenate, followed by sulfurization and super-alkalization, then carbonation, distillation, filtration, and degassing in air.

European Patent Application No. 98 400 203.0 discloses an unsulfurized, alkali metal-free detergent-dispersant additive, comprising a mixture of alkaline earth metal salts (alkylphenate/alkylsalicylate) and unreacted alkylphenol. This additive improves antioxidant properties, high temperature deposit control, and black sludge control.

The addition of aliphatic carboxylic acids during the preparation of lubricating oil detergents is known. The resulting detergents can be referred to as carboxylic acid modified detergents and a variety of such detergents are known. The incorporation of aliphatic carboxylic acids into such detergents is known to modify theirs physical and/or performance properties. The most common physical modification observed by the incorporation of a fatty acids into detergents, which is also the most common reason for performing this modification, is an increase in the TBN of the detergent without deleteriously increasing the viscosity of the product to an unacceptable level.

U.S. Pat. No. 3,493,516 discloses the use of short chain carboxylic acids in the production of overbased phenates, which allows an increase in the TBN without excessive viscosity increase.

European Patent Application No. 385,616 discloses the use of fatty acids in the production of overbased phenates from alkylphenols or phenates with increased TBN's and acceptable viscosity.

European Patent Application No. 351,052 discloses the use of long chain carboxylic acids in the production of overbased salicylate detergents with TBN's greater than 300 and viscosity's less than 1000 cSt at 100° C.

European Patent Application No. 347,104 discloses the use of long chain carboxylic acids to produce overbased carboxylic modified low overbased sulphonates and/or phenates and/or salicylate detergents with improved deposit forming properties.

European Patent Application No. 347,103 discloses a process for producing carboxylic acid modified overbased phenates with TBN's greater than 350 and viscosities less than 1000 cSt at 100° C. starting from a phenate.

European Patent Application No. 351,053 discloses the production of carboxylic acid modified overbased sulphonates with TBN's greater than 300 and viscosities less than 1000 cSt at 100° C. that have better filtration processing characteristics.

U.S. Pat. No. 5,716,914 discloses a process for producing a carboxylic acid modified overbased phenate with TBN's greater than 300 and viscosities less than 1000 cSt at 100° C.

U.S. Pat. No. 5,069,804/European Patent Application No. 0,094,814 discloses a process for the production of carboxylic acid modified overbased phenates with improved foaming properties.

U.S. Pat. No. 5,714,443 discloses a process for the production of carboxylic acid modified overbased phenates with TBN's greater than 350 and viscosites less than 1000 cSt at 100° C.

U.S. Pat. No. 5,433,871 discloses a process for the production of carboxylic acid modified overbased mixed detergents (phenate and/or salicylate and/or napthenate and/or sulfonate) with TBN's greater than 300.

SUMMARY OF THE INVENTION

The present invention provides process for producing an overbased alkaline earth metal single-aromatic ring hydrocarbyl salicylate-carboxylate useful for improving the compatibility with sulfonates, solubility in severe base stocks, BN retention, and thermal oxidation stability of a lubricating oil.

That process comprises contacting a mixture comprising an alkaline earth metal single-aromatic ring hydrocarbyl salicylate, at least one solvent, metal hydroxide, and an alkyl polyhydric alcohol containing from one to five carbon atoms with carbon dioxide under overbasing reaction conditions. The overbased alkaline earth metal single-aromatic ring hydrocarbyl salicylate is treated, before, during, or subsequent to overbasing, with a long-chain carboxylic acid, anhydride, or salt thereof to form an alkaline earth metal single-aromatic ring hydrocarbyl salicylate-carboxylate.

Preferably, the alkaline earth metal single-aromatic ring hydrocarbyl salicylate is a single-aromatic ring alkylsalicylate. More preferably, it is a sulfurized calcium single-aromatic ring alkylsalicylate.

Preferably, the metal hydroxide is an alkaline earth metal hydroxide. More preferably, it is calcium hydroxide.

Preferably, the mixture further comprises a metal chloride, more preferably an aqueous metal chloride. Preferably, the metal chloride is an alkaline earth metal chloride, more preferably calcium chloride.

Preferably, the alkyl polyhydric alcohol is ethylene glycol.

Preferably, the mixture further comprises a hydrocarbyl phenate, more preferably an alkaline earth metal alkylphenate, most preferably a sulfurized calcium alkylphenate.

Preferably, the mixture further comprises a hydrocarbyl phenol, more preferably an alkylphenol.

Preferably, the mixture further comprises a double-aromatic ring hydrocarbyl salicylate wherein the mole ratio of single-aromatic ring hydrocarbyl salicylate to double-aromatic ring hydrocarbyl salicylate is at least 8:1.

Preferably, the long-chain carboxylic acid is stearic acid.

The overbased alkaline earth metal single-aromatic ring hydrocarbyl salicylate-carboxylate prepared by this process can be used in a lubricating oil composition comprising a major portion of an oil of lubricating viscosity. Such a lubricating oil formulation would typically comprise:

(a) a major amount of a base oil of lubricating viscosity,
(b) from 1 % to 30% of the overbased alkaline earth metal single-aromatic ring hydrocarbyl salicylate-carboxylate,
(c) from 0% to 20% of at least one ashless dispersant,
(d) from 0% to 5% of at least one zinc dithiophosphate,
(e) from 0% to 10% of at least one oxidation inhibitor,
(f) from 0% to 1% of at least one foam inhibitor, and
(g) from 0% to 20% of at least one viscosity index improver.

The invention also provides a concentrate comprising the overbased alkaline earth metal single-aromatic ring hydrocarbyl salicylate-carboxylate, an organic diluent, and preferably at least one other additive. The organic diluent constitutes from 10% to 90% of the concentrate.

The invention also provides a method for improving the compatibility with sulfonates, solubility in severe base stocks, BN retention, and thermal oxidation stability of lubricating oil. That method comprises adding to the lubricating oil an effective amount of the overbased alkaline earth metal single-aromatic ring hydrocarbyl salicylate-carboxylate of the present invention.

The invention also provides a hydraulic oil composition containing a base oil of lubricating viscosity, from 0.1% to 3.0% of the overbased alkaline earth metal single-aromatic ring hydrocarbyl salicylate-carboxylate of the present invention, and preferably at least one other additive.

An alternative method for producing an overbased alkaline earth metal hydrocarbyl single-aromatic ring salicylate-carboxylate comprises:

(a) neutralization of hydrocarbyl phenols, which has been treated, before or during neutralization with a long-chain carboxylic acid, anhydride, or salt thereof, using an alkaline earth metal base in the presence of at least one carboxylic acid containing from one to four carbon atoms, and in the absence of alkali base, dialcohol, and mono alcohol, to produce an hydrocarbyl phenate wherein:
  (1) the neutralization operation is carried out at a temperature of at least 200° C.;
  (2) the pressure is reduced gradually below atmospheric in order to remove the water of reaction, in the absence of any solvent that may form an azeotrope with water;
  (3) the hydrocarbyl phenols contain up to 85% of linear hydrocarbyl phenol in mixture with at least 15% of branched hydrocarbyl phenol in which the branched hydrocarbyl radical contains at least nine carbon atoms; and
  (4) the quantities of reagents used correspond to the following molar ratios: (a) metal base/hydrocarbyl phenol of 0.2:1 to 0.7:1; and (b) carboxylic acid/hydrocarbyl phenol of from 0.01:1 to 0.5:1;
(b) carboxylation of the hydrocarbyl phenate obtained in step (a) using carbon dioxide under carboxylation conditions sufficient to convert at least 20 mole % of the starting hydrocarbyl phenols to hydrocarbyl salicylate; and
(c) contacting a mixture comprising the product of step (b), at least one solvent, metal hydroxide, and an alkyl polyhydric alcohol containing from one to five carbon atoms with carbon dioxide under overbasing reaction conditions.

In this alternative embodiment, preferably the hydrocarbyl phenols are alkylphenols, the alkaline earth metal base is calcium base, the metal hydroxide is an alkaline earth metal hydroxide (such as calcium hydroxide), and the alkyl polyhydric alcohol is ethylene glycol.

Preferably, the mixture in step (c) further comprises an aqueous metal chloride, like aqueous calcium chloride.

DETAILED DESCRIPTION OF THE INVENTION

In its broadest aspect, the present invention involves an overbased alkaline earth metal hydrocarbyl single-aromatic ring salicylate-carboxylate useful for improving the compatibility with sulfonates, solubility in severe base stocks, BN retention, and thermal oxidation stability of a lubricating oil.

Prior to discussing the invention in further detail, the following terms will be defined:

DEFINITIONS

As used herein the following terms have the following meanings unless expressly stated to the contrary:

The term "hydrocarbyl" means an alkyl or alkenyl group.

The term "metal" means alkali metals, alkaline earth metals, or mixtures thereof.

The term "alkaline earth metal" means calcium, barium, magnesium, strontium, or mixtures thereof.

The term "alkaline earth metal single aromatic-ring hydrocarbyl salicylate" means an alkaline earth metal salt of a hydrocarbyl salicylic acid, wherein there is only one hydrocarbyl salicylic anion per each alkaline earth metal base cation.

The term "alkaline earth metal single aromatic-ring alkylsalicylate" means an alkaline earth metal single aromatic-ring hydrocarbyl salicylate wherein the hydrocarbyl group is an alkyl group.

The term "alkaline earth metal double aromatic-ring hydrocarbyl salicylate" means an alkaline earth metal salt of a hydrocarbyl salicylic acid, wherein there are two hydrocarbyl salicylic anions per each alkaline earth metal base cation.

The term "alkaline earth metal double aromatic-ring alkylsalicylate" means an alkaline earth metal double aromatic-ring hydrocarbyl salicylate wherein the hydrocarbyl groups are alkyl groups.

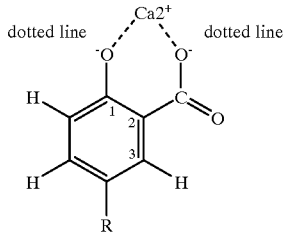

SINGLE AROMATIC RING SALICYLATE

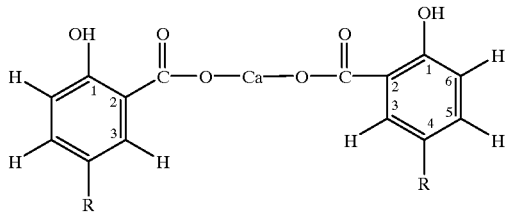

DOUBLE AROMATIC RING SALICYLATE

The term "hydrocarbyl phenol" means a phenol group having one or more hydrocarbyl substituents; at least one of which has a sufficient number of carbon atoms to impart oil solubility to the phenol.

The term "alkylphenol" means a phenol group having one or more alkyl substituents, wherein at least one of the alkyl substituents has a sufficient number of carbon atoms to impart oil solubility to the phenol.

The term "phenate" means a metal salt of a phenol.

The term "hydrocarbyl phenate" means a metal salt of a hydrocarbyl phenol.

The term "alkaline earth metal alkylphenate" means an alkaline earth metal salt of an alkylphenol.

The term "long-chain carboxylic acid" means a carboxylic acid having an alkyl group having an average carbon number of from 13 to 28. The alkyl group may be linear, branched, or mixtures thereof.

The term "stearic acid" means a long-chain carboxylic acid, wherein the carbon number of the acid is predominately 18.

The term "alkaline earth metal single aromatic-ring hydrocarbyl salicylate-carboxylate" means an alkaline earth metal single aromatic-ring hydrocarbyl salicylate that has been treated with a long-chain carboxylic acid, anhydride, or salt thereof.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

Unless otherwise specified, all percentages are in weight percent.

PREPARATION OF THE ALKALINE EARTH METAL SINGLE AROMATIC-RING HYDROCARBYL SALICYLATE

A. NEUTRALIZATION STEP

In the first step, hydrocarbyl phenols are neutralized using an alkaline earth metal base in the presence of at least one $C_1$ to $C_4$ carboxylic acid. This reaction is carried out in the absence of alkali base, and in the absence of dialcohol or monoalcohol.

The hydrocarbyl phenols contain up to 85% of linear hydrocarbyl phenol (preferably at least 35% linear hydrocarbyl phenol) in mixture with at least 15% of branched alkylphenol. Preferably, the hydrocarbyl group is alkyl, the linear alkyl radical contains 12 to 40 carbon atoms, more preferably 18 to 30 carbon atoms. The branched hydrocarbyl radical is preferably alkyl and contains at least nine carbon atoms, preferably 9 to 24 carbon atoms, more preferably 10 to 15 carbon atoms.

The use of an alkylphenol containing at least 35% of long linear alkylphenol (from 18 to 30 carbon atoms) is particularly attractive because a long linear alkyl chain promotes the compatibility and solubility of the additives in lubricating oils. However, the presence of relatively heavy linear alkyl radicals in the alkylphenols makes the latter less reactive than branched alkylphenols, hence the need to use harsher reaction conditions to bring about their neutralization by an alkaline earth metal base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively reactive towards an alkaline earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, para, and meta positions is much more uniformly distributed. This makes them much less reactive towards an alkaline earth metal base since the phenol function is much less accessible due to considerable steric hindrance, due to the presence of closer and generally heavier alkyl substituents.

The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The $C_1$ to $C_4$ carboxylic acids used in this step include formic, acetic, propionic and butyric acid, and may be used alone or in mixture. Preferably, a mixture of acids is used, most preferably a formic acid/acetic acid mixture. The molar ratio of formic acid/acetic acid should be from 0.2:1 to 100:1, preferably between 0.5:1 and 4:1, and most preferably 1:1. The carboxylic acids act as transfer agents, assisting the transfer of the alkaline earth metal bases from a mineral reagent to an organic reagent.

The neutralization operation is carried out at a temperature of at least 200° C., preferably at least 215° C., and more preferably at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

The quantities of reagents used should correspond to the following molar ratios:

(1) alkaline earth metal base/alkylphenol of 0.2:1 to 0.7:1, preferably 0.3:1 to 0.5:1; and (2) carboxylic acid/alkylphenol of 0.01:1 to 0.5:1, preferably from 0.03:1 to 0.15:1.

Preferably, at the end of this neutralization step the alkylphenate obtained is kept for a period not exceeding fifteen hours at a temperature of at least 215° C. and at an absolute pressure of between 5,000 and $10^5$ Pa (between 0.05 and 1.0 bar). More preferably, at the end of this neutralization step the alkylphenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carded out without the need to add a solvent that forms an azeotrope with the water formed during this reaction.

B. CARBOXYLATION STEP

The carboxylation step is conducted by simply bubbling carbon dioxide into the reaction medium originating from the preceding neutralization step and is continued until at least 20 mole % of the alkylphenate to alkylsalicylate (measured as salicylic acid by potentiometric determination). It must take place under pressure in order to avoid any decarboxylation of the alkylsalicylate that forms.

Preferably, at least 22 mole % of the starting alkylphenols is converted to alkylsalicylate using carbon dioxide at a temperature of between 180° and 240° C., under a pressure within the range of from above atmospheric pressure to $15\times10^5$ Pa (15 bars) for a period of one to eight hours.

According to one variant, at least 25 mole % of the starting alkylphenols is converted to alkylsalicylate using carbon dioxide at a temperature equal to or greater than 200° C. under a pressure of $4\times10^5$ Pa (4 bars).

C. ALKALINE EARTH METAL HYDROCARBYL SALICYLATE PRODUCT

The alkaline earth metal single aromatic-ring hydrocarbyl salicylate formed by this method can be characterize by its unique composition, with much more hydrocarbyl phenol and alkaline earth metal single aromatic-ring hydrocarbyl salicylate than produced by other routes. When the hydrocarbyl group is an alkyl group, that detergent-dispersant has the following composition;

(a) from 40% to 60% alkylphenol, (b) from 10% to 40% alkaline earth metal alkylphenate, and (c) from 20% to 40% alkaline earth metal single aromatic-ring alkylsalicylate.

Unlike alkaline earth metal alkylsalicylates produced by other process, this detergent-dispersant composition can be characterized by having only minor amounts of an alkaline earth metal double aromatic-ring alkylsalicylates. The mole ratio of single aromatic-ring alkylsalicylate to double aromatic-ring alkylsalicylate is at least 8:1.

OVERBASING PROCESS

A mixture of an alkaline earth metal single-aromatic ring salicylate, at least one solvent, and alkaline earth metal hydroxide is overbased by contacting the mixture with carbon dioxide in the presence of an alkyl polyhydric alcohol, wherein the alkyl group of the alcohol has from one to five carbon atoms.

In order to reduce the fine sediments, one should maintain the level of agitation sufficiently high so that all solids are suspended over the length of the overbasing step. Preferably, one should also maintain a polyhydric alcohol to water ratio sufficiently high so that the ratio is at least 4:1 at the end of the overbasing step.

In order to further reduce the fine sediments, one should maintain a polyhydric alcohol to water ratio sufficiently high so that the ratio is at least 9:1 at the end of the overbasing step.

The alkyl group of the alkyl polyhydric alcohol should have from one to five carbon atoms. One such useful alkyl polyhydric alcohol is ethylene glycol.

ALTERNATIVE METHOD FOR PREPARATION OF THE ALKALINE EARTH METAL SINGLE AROMATIC-RING HYDROCARBYL SALICYLATE-CARBOXYLATE

In an alternative process for producing an overbased alkaline earth metal hydrocarbyl single-aromatic ring salicylate-carboxylate, the hydrocarbyl phenols are neutralized and treated with a long-chain carboxylic acid, then they are carboxylated and overbased.

The hydrocarbyl phenols (preferably alkylphenols) are treated before or during neutralization with a long-chain carboxylic acid, anhydride, or salt thereof. In the neutralization step, the hydrocarbyl phenols are neutralized using an alkaline earth metal base in the presence of at least one carboxylic acid containing from one to four carbon atoms, and in the absence of alkali base, dialcohol, and monoalcohol, to produce an hydrocarbyl phenate-carboxylate.

The neutralization operation is carried out at a temperature of at least 200° C., and the pressure is reduced gradually below atmospheric in order to remove the water of reaction, in the absence of any solvent that may form an azeotrope with water. During that operation, the hydrocarbyl phenols contain up to 85% of linear hydrocarbyl phenol in mixture with at least 15% of branched hydrocarbyl phenol in which the branched hydrocarbyl radical contains at least nine carbon atoms; and the quantities of reagents used correspond to the following molar ratios:

(a) alkaline earth metal base/hydrocarbyl phenol of 0.2:1 to 0.7:1; and (b) carboxylic acid/hydrocarbyl phenol of from 0.01:1 to 0.5:1;

The hydrocarbyl phenate-carboxylate obtained in the neutralization operation is carboxylated using carbon dioxide under carboxylation conditions sufficient to convert at least 20 mole % of the starting hydrocarbyl phenols to hydrocarbyl salicylate-carboxylate.

The product of carboxylation step is mixed with at least one solvent, metal hydroxide (preferably alkaline earth metal hydroxide, most preferably calcium hydroxide), and an alkyl polyhydric alcohol containing from one to five carbon atoms (preferably ethylene glycol), and the resulting mixture is reacted with carbon dioxide under overbasing reaction conditions. Preferably, the mixture also has an aqueous metal chloride (most preferably an aqueous calcium chloride).

BASE OIL OF LUBRICATING VISCOSITY

The base oil of lubricating viscosity used in such compositions may be mineral oil or synthetic oils of viscosity suitable for use in the crankcase of an internal combustion engine. Crankcase base oils ordinarily have a viscosity of about 1300 cSt at 0° F. (−18° C.) to 24 cSt at 210° F. (99° C.). The base oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, penta-erythritol tetracaproate, di-2-ethylhexyl adipate, dilaurylsebacate, and the like. Complex esters prepared from mixtures of mono and dicarboxylic acids and mono and dihydroxy alkanols can also be used.

Blends of mineral oils with synthetic oils are also useful. For example, blends of 10 to 25% hydrogenated -trimer with 75 to 90% 150 SUS (100° F.) mineral oil make excellent lubricating oil bases.

OTHER ADDITIVE COMPONENTS

The following additive components are examples of some components that can be favorably employed in the present invention. These examples of additives are provided to illustrate the present invention, but they are not intended to limit it:

(1) Ashless dispersants: alkenyl succinimides, alkenyl succinimides modified with other organic compounds, and alkenyl succinimides modified with boric acid, alkenyl succinic ester.

(2) Oxidation inhibitors:

(a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butylidenebis(3-methyl-6-tert-butylphenol), 4,4'-isopropyl-idenebis(2,6-di-tert-butylphenol), 2,2'-methylene-bis(4-methyl-6-nonylphenol), 2,2'-isobutylidene-bis(4,6dimethyl-phenol), 2,2'-methylenebis (4-methyl-6-cyclohexylphenol), 2,6-di-tert-butyl4-methyl-phenol, 2,6-di-tert-butyl4-ethylphenol, 2,4-dimethyl-6-tert-butyl-phenol, 2,6-di-tert-4-(N,N'-dimethyl-aminomethylphenol), 4,4'-thiobis(2-methyl-6-tert-butylphenol), 2,2'-thiobis(4-methyl-6-tert-butylphenol), bis(3-methyl4-hydroxy-5-tert-butylbenzylysulfide, and bis (3,5-di-tert-butyl4-hydroxybenzyl).

(b) Diphenylamine type oxidation inhibitor: alkylated diphenylamine, phenyl-α-naphthylamine, and alkylated α-naphthylamine.

(c) Other types: metal dithiocarbamate (e.g., zinc dithiocarbamate), and methylenebis (dibutyldithiocarbamate).

(3) Rust inhibitors (Anti-rust agents)

(a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitan ester.

(5) Extreme pressure agents (EP agents): zinc dialkyldithiophosphate (primary alkyl type & secondary alkyl type), sulfurized oils, diphenyl sulfide, methyl trichlorostearate, chlorinated naphthalene, fluoroalkylpolysiloxane, and lead naphthenate.

(6) Friction modifiers: fatty alcohol, fatty acid, amine, borated ester, and other esters.

(7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(8) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

LUBRICATING OIL COMPOSITION

The overbased alkaline earth metal single-aromatic ring hydrocarbyl salicylate-carboxylate produced by the process of this invention is useful for imparting detergency to an engine lubricating oil composition. Such a lubricating oil composition comprises a major part of a base oil of lubricating viscosity and an effective amount of overbased alkaline earth metal single-aromatic ring hydrocarbyl salicylate-carboxylate.

Adding an effective amount of the overbased alkaline earth metal single-aromatic ring hydrocarbyl salicylate-carboxylate of the present invention to a lubricating oil improves the detergency of that lubricating oil in automotive applications.

In one embodiment, an engine lubricating oil composition would contain (a) a major part of a base oil of lubricating viscosity;

(b) 1% to 30% of overbased alkaline earth metal single-aromatic ring hydrocarbyl salicylate-carboxylate;

(c) 0% to 20% of at least one ashless dispersant;

(d) 0% to 5% of at least one zinc dithiophosphate;

(e) 0% to 10% of at least one oxidation inhibitor;

(f) 0% to 1% of at least one foam inhibitor; and (g) 0% to 20% of at least one viscosity index improver.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

HYDRAULIC OIL COMPOSITION

A hydraulic oil composition having improved filterability can be formed containing a major part of a base oil of lubricating viscosity, from 0.1% to 3% of the overbased alkaline earth metal single-aromatic ring hydrocarbyl salicylate-carboxylate of the present invention, and preferably at least one other additive.

ADDITIVE CONCENTRATES

Additive concentrates are also included within the scope of this invention. The concentrates of this invention comprise the compounds or compound mixtures of the present invention, with at least one of the additives disclosed above. Typically, the concentrates contain sufficient organic diluent to make them easy to handle during shipping and storage.

From 20% to 80% of the concentrate is organic diluent. From 0.5% to 80% of concentrate is the detergent-dispersant additive of the present invention. That detergent-dispersant additive contains the single-aromatic ring salicylate-carboxylate, and possibly alkylphenol and alkylphenate. The remainder of the concentrate consists of other additives.

Suitable organic diluents that can be used include mineral oil or synthetic oils, as described above in the section entitled "Base Oil of Lubricating Viscosity." The organic diluent preferably has a viscosity of from about 1 to about 20 cSt at 100° C.

EXAMPLES OF ADDITIVE PACKAGES

Below are representative examples of additive packages that can be used in a variety of applications. These representative examples employ the detergent-dispersant additive of the present invention. That detergent-dispersant additive contains the single-aromatic ring hydrocarbyl salicylate-arboxylate, and possibly hydrocarbyl phenol and hydrocarbyl phenate. That detergent-dispersant additive may be used either with or without other metal-containing detergents, depending upon the desired BN of the final product. The following percentages are based on the amount of active component, with neither process oil nor diluent oil, but including sufficient metal-containing detergents (including other types of metal detergents) to achieve the desired BN. These examples are provided to illustrate the present invention, but they are not intended to limit it.

| I. Marine Diesel Engine Oils | | |
|---|---|---|
| 1) | Detergent-dispersant additive | 65% |
| | Primary alkyl zinc dithiophosphate | 5% |
| | Oil of lubricating viscosity | 30% |
| 2) | Detergent-dispersant additive | 65% |
| | Alkenyl succinimide ashless dispersant | 5% |
| | Oil of lubricating viscosity | 30% |
| 3) | Detergent-dispersant additive | 60% |
| | Primary alkyl zinc dithiophosphate | 5% |
| | Alkenyl succinimide ashless dispersant | 5% |
| | Oil of lubricating viscosity | 30% |
| 4) | Detergent-dispersant additive | 65% |
| | Phenol type oxidation inhibitor | 10% |
| | Oil of lubricating viscosity | 25% |
| 5) | Detergent-dispersant additive | 55% |
| | Alkylated diphenylamine-type oxidation inhibitor | 15% |
| | Oil of lubricating viscosity | 30% |
| 6) | Detergent-dispersant additive | 65% |
| | Phenol-type oxidation inhibitor | 5% |
| | Alkylated diphenylamine-type oxidation inhibitor | 5% |
| | Oil of lubricating viscosity | 25% |

-continued

| | | |
|---|---|---|
| 7) | Detergent-dispersant additive | 60% |
| | Primary alkyl zinc dithiophosphate | 5% |
| | Phenol-type oxidation inhibitor | 5% |
| | Oil of lubricating viscosity | 30% |
| 8) | Detergent-dispersant additive | 60% |
| | Alkenyl succinimide ashless dispersant | 5% |
| | Alkylated diphenylamine-type oxidation inhibitor | 10% |
| | Oil of lubricating viscosity | 25% |
| 9) | Detergent-dispersant additive | 55% |
| | Other additives | 25% |
| | Primary alkyl zinc dithiophosphate | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |
| II. | Motor Car Engine Oils | |
| 1) | Detergent-dispersant additive | 25% |
| | Alkenyl succinimide ashless dispersant | 35% |
| | Primary alkyl zinc dithiophosphate | 10% |
| | Oil of lubricating viscosity | 30% |
| 2) | Detergent-dispersant additive | 20% |
| | Alkenyl succinimide ashless dispersant | 40% |
| | Secondary alkyl zinc dithiophosphate | 5% |
| | Dithiocarbamate type oxidation inhibitor | 5% |
| | Oil of lubricating viscosity | 30% |
| 3) | Detergent-dispersant additive | 20% |
| | Alkenyl succinimide ashless dispersant | 35% |
| | Secondary alkyl zinc dithiophosphate | 5% |
| | Phenol type oxidation inhibitor | 5% |
| | Oil of lubricating viscosity | 35% |
| 4) | Detergent-dispersant additive | 20% |
| | Alkenyl succinimide ashless dispersant | 30% |
| | Secondary alkyl zinc dithiophosphate | 5% |
| | Dithiocarbamate type anti-wear agent | 5% |
| | Oil of lubricating viscosity | 40% |
| 5) | Detergent-dispersant additive | 20% |
| | Succinimide ashless dispersant | 30% |
| | Secondary alkyl zinc dithiophosphate | 5% |
| | Molybdenum-containing anti-wear agent | 5% |
| | Oil of lubricating viscosity | 40% |
| 6) | Detergent-dispersant additive | 20% |
| | Alkenyl succinimide ashless dispersant | 30% |
| | Other additives | 10% |
| | Primary alkyl zinc dithiophosphate | |
| | Secondary alkyl zinc dithiophosphate | |
| | Alkylated diphenylamine-type oxidation inhibitor | |
| | Dithiocarbamate type anti-wear agent | |
| | Oil of lubricating viscosity | 40% |
| 7) | Detergent-dispersant additive | 60% |
| | Other additives | 10% |
| | Phenol type oxidation inhibitor | |
| | Alkylated diphenylamine-type | |
| | Oxidation inhibitor | |
| | Dithiocarbamate type anti-wear agent | |
| | Demulsifier | |
| | Boron-containing friction modifier | |
| | Oil of lubricating viscosity | 30% |
| III. | Hydraulic Oils | |
| 1) | Detergent-dispersant additive | 20% |
| | Primary alkyl zinc dithiophosphate | 50% |
| | Other additives | 25% |
| | Phenol type oxidation inhibitor | |
| | Phosphorous-containing extreme pressure agent | |
| | Triazol type corrosion inhibitor | |
| | Demulsifier | |
| | Nonionic anti-rust agent | |
| | Oil of lubricating viscosity | 5% |
| 2) | Detergent-dispersant additive | 10% |
| | Primary alkyl zinc dithiophosphate | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |

-continued

| | | |
|---|---|---|
| 3) | Detergent-dispersant additive | 10% |
| | Phosphorous-containing extreme pressure agent | 40% |
| | Phenol type oxidation inhibitor | 15% |
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | Detergent-dispersant additive | 20% |
| | Phosphorous-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 5% |
| IV. | Transmission Hydraulic Fluids | |
| 1) | Detergent-dispersant additive | 35% |
| | Primary alkyl zinc dithiophosphate | 20% |
| | Polyol type friction modifier | 20% |
| | Sulfur-containing extreme pressure agent | 5% |
| | Oil of lubricating viscosity | 20% |
| 2) | Detergent-dispersant additive | 40% |
| | Primary alkyl zinc dithiophosphate | 15% |
| | Amide type friction modifier | 15% |
| | Sulfur-containing extreme pressure agent | 5% |
| | Oil of lubricating viscosity | 25% |
| 3) | Detergent-dispersant additive | 30% |
| | Primary alkyl zinc dithiophosphate | 20% |
| | Other additives | 30% |
| | Alkenyl succinimide ashless dispersant | |
| | Amide type friction modifier | |
| | Ester type friction modifier | |
| | Phosphorous, Sulfur-containing extreme pressure agent | |
| | Oil of lubricating viscosity | 20% |
| 4) | Detergent-dispersant additive | 35% |
| | Primary alkyl zinc dithiophosphate | 15% |
| | Other additives | 25% |
| | Polyol type friction modifier | |
| | Amide type friction modifier | |
| | Phosphorous, Sulfur-containing extreme pressure agent | |
| | Oil of lubricating viscosity | 25% |

EXAMPLES

The invention will be further illustrated by following examples, which set forth particularly advantageous method embodiments. While the Examples are provided to illustrate the present invention, they are not intended to limit it.

EXAMPLE 1

To a three neck round bottom flask was charged 325 grams 100 N oil, 268.8 grams of stearic acid 283.3, 0.2 grams of antifoam, 6.64 grams calcium chloride dihydrate, 688 grams 2-ethylhexanol and 34.4 grams of ethylene glycol at approximately 20° C. Agitation was started and then 283.3 grams of lime were added. This mixture was heated to 80° C. at atmospheric pressure with stirring over twenty minutes and held at 80° C. for fifteen minutes. When the reaction reached 80° C., an additional 200 grams of 2-ethylhexanol was added to the reaction. The pressure was then reduced to approximately 680 mm Hg and the mixture was heated to 150° C. over thirty minutes. When the reactor temperature reached 150° C., the pressure was increased to atmospheric pressure and 800 grams of an overbased, sulfurized, detergent-dispersant additive (as described in PCT patent application PCT/FR95/00299) was added and then reduced to 680 mm Hg again. The temperature was the increased to 170° C. over one hour at 680 mm Hg pressure. When the temperature reached 170° C., the pressure was increased to atmospheric pressure and 60 grams of ethylene glycol was added at a rate of 0.57 grams/minute. Immediately after starting this glycol addition, 129 grams of $CO_2$ was added to the reaction at a rate of 0.7 grams/minute. An additional 16 grams of $CO_2$ were then added to the reaction at a rate of 0.51 grams/minute. The solvent was distilled by increasing the reaction temperature to 195° C. over approximately minutes and reducing the pressure to approximately 40 mm Hg over 15 minutes. The reaction was held at 195° C. and 40 mm Hg for one hour. The crude product was then filtered with the aid of filter aid through a Buchner funnel. The filtered product had the following physical properties: TBN=348; Viscosity=246 cSt (100° C.); 12.4% Ca; 9.0 % $CO_2$; 1.38% S.

EXAMPLE 2

To a 3 liter 3 neck round bottom flask was added 267 grams 100 N oil, 440 grams decyl alcohol, 0.5 grams antifoam, 49 grams ethylene glycol, 400 grams of lime and 400 grams of an unsulfurized, alkali metal-free detergent-dispersant additive (as described in European Patent Application No. 98 400 203.0), 225 grams of molten stearic acid, 11 grams calcium chloride dihydrate and 58 grams of sulfur. The stirrer was started, the pressure reduced to 730 mm Hg and the reaction was heated to 160° C. over 1.5 hours. When the reaction reached 160° C., 35 grams of ethylene glycol was added at 0.23 grams/min over 1.5 hours. When the ethylene glycol was added, the reaction was heated to 175° C. over fifteen minutes. When the reaction reached 175° C., the pressure was increased to atmospheric pressure and $CO_2$ was added at two different rates: 175 grams $CO_2$ was added over 2.5 hours at 1.17 grams/min and then 26 grams was added over thirty minutes at 0.87 grams/min. Immediately after starting the first $CO_2$ addition, the addition of 56 grams of ethylene glycol was begun over two hours at a rate of 0.27 grams/min. After the $CO_2$ addition was complete, the reaction was heated to 205° C. and pressure reduced to 30 mm Hg over thirty minutes. The reaction was held at 205° C. and 30 mm Hg for one hour and then cooled to approximately 70° C. and filtered with the aid of filter aid through a Buchner funnel. The filtered product had the following physical properties: TBN=406; Viscosity=3793 cSt (1000C); 11.1% $CO_2$; 14.7% Ca; 1.52% S.

Dilution of a portion of this filtered product with 100 N oil afforded a product with the following TBN and viscosity: TBN=374; Viscosity 1034 cSt (100° C.).

EXAMPLE 3 a) Neutralization step:

To a 4 liter stainless reactor were added:

253 grams branched alkylphenol (where the alkyl chain was propylene tetramer)

253 grams linear alkylphenol (where alkyl chain was a mixture of $C_{20-28}$ normal alpha-olefins)

0.2 grams of foam inhibitor 582 grams 100 N Neutral oil 700 grams of 2-Ethylhexanol 8.0 grams of calcium chloride ($CaCl_2$, $2H_{20}$) 41.3 grams g of glycol The procedure was:

Start agitator at heat up

At 65° C. load 87 grams of lime, at 80° C. load 6.7 grams of a mixture formic acid/acetic acid 50/50 wt. Then load 322 grams of molten stearic acid. Heat up to 200° C. and stay four hours under reflux.

The reaction is heated to 195° C. and pressure reduced to 40 mm Hg over thirty minutes.

Hold thirty minutes in these final conditions.

b) Carboxylation Step:

The reaction was held for four hours at 200° C. under a pressure of $CO_2$ of 3.5 bar.

c) Sulfurization/overbasing Step:

To a 4 liter 3 neck round bottom flask were added 1277 grams of the product obtained at the end of step b), 18 grams 100 Neutral oil and 700 grams of isodecanol. Then the mixture was heat up to 143° C. over a period of 45 minutes; at 80° C. 357.8 grams of lime was loaded. The product was heated at 149° C. over a period of 15 minutes, and at 177° C. over a period of one hour. During this period, 79 grams of glycol was introduced in order to complete the sulfurization.

Carbonation/overbasing is conducted at 177° C. during this step, 155 grams $CO_2$ are introduced over a period of 5 hours.

The elimination of glycol and isodecanol was done by simultaneously heating the material up to 220° C. and reducing pressure down to 40 mm Hg and holding one hour in these conditions.

After filtration, the product was analyzed:

BN D2896:357

% Ca: 12.92

% S: 1.36

% $CO_2$: 9.66

Viscosity at 100° C.: 241.3 cSt

While the present invention has been described with reference to specific embodiments, this application is intended to cover those various changes and substitutions that may be made by those skilled in the art without departing from the spirit and scope of the appended claims.

What is claimed is:

1. A process for producing an overbased alkaline earth metal single-aromatic ring hydrocarbyl salicylate-carboxylate, said process comprising contacting a mixture comprising an alkaline earth metal single-aromatic ring hydrocarbyl salicylate, at least one solvent, metal hydroxide, and an alkyl polyhydric alcohol containing from one to five carbon atoms with carbon dioxide under overbasing reaction conditions, wherein said alkaline earth metal single-aromatic ring hydrocarbyl salicylate has been treated, before, during, or subsequent to overbasing, with a long-chain carboxylic acid, anhydride, or salt thereof to form an alkaline earth metal single-aromatic ring hydrocarbyl salicylate-carboxylate.

2. A process according to claim 1 wherein said alkaline earth metal single-aromatic ring hydrocarbyl salicylate is a alkaline earth metal single-aromatic ring alkylsalicylate.

3. A process according to claim 2 wherein said alkaline earth metal single-aromatic ring alkylsalicylate is a sulfurized alkaline earth metal single-aromatic ring alkylsalicylate.

4. A process according to claim 1 wherein said metal hydroxide is an alkaline earth metal hydroxide.

5. A process according to claim 4 wherein said alkaline earth metal hydroxide is calcium hydroxide.

6. A process according to claim 1 wherein said mixture further comprises a metal chloride.

7. A process according to claim 6 wherein said metal chloride is an aqueous metal chloride.

8. A process according to claim 7 wherein said metal chloride is an alkaline earth metal chloride.

9. A process according to claim 8 wherein said alkaline earth metal chloride is calcium chloride.

10. A process according to claim 1 wherein said alkyl polyhydric alcohol is ethylene glycol.

11. A process according to claim 1 wherein said mixture further comprises a hydrocarbyl phenate.

12. A process according to claim 11 wherein said hydrocarbyl phenate is an alkaline earth metal alkylphenate.

13. A process according to claim 12 wherein said alkaline earth metal alkylphenate is a sulfurized calcium alkylphenate.

14. A process according to claim 1 wherein said mixture further comprises a hydrocarbyl phenol.

15. A process according to claim 14 wherein said hydrocarbyl phenol is an alkylphenol.

16. A process according to claim 1 wherein said mixture further comprises an alkaline earth metal double-aromatic ring hydrocarbyl salicylate wherein the mole ratio of alkaline earth metal single-aromatic ring hydrocarbyl salicylate to alkaline earth metal double-aromatic ring hydrocarbyl salicylate is at least 8:1.

17. A process according to claim 1 wherein the long-chain carboxylic acid is stearic acid.

18. An overbased alkaline earth metal single-aromatic ring hydrocarbyl salicylate-carboxylate prepared by the process according to claim 1.

19. A lubricating oil composition comprising a major portion of a base oil of lubricating viscosity and a minor portion of the overbased alkaline earth metal single-aromatic ring hydrocarbyl salicylate-carboxylate according to claim 18.

20. A method for improving the compatibility with sulfonates, solubility in severe base stocks, BN retention, and thermal oxidation stability of a lubricating oil, said method comprising adding to said lubricating oil the overbased alkaline earth metal single-aromatic ring hydrocarbyl salicylate-carboxylate according to claim 18.

21. A lubricating oil formulation comprising:

(a) a major amount of a base oil of lubricating viscosity;

(b) from 1 to 30% of the overbased alkaline earth metal single-aromatic ring hydrocarbyl salicylate-carboxylate according to claim 18;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

22. A concentrate comprising about from 10% to 90% of a compatible organic liquid diluent and about from 0.5% to 90% of the overbased alkaline earth metal single-aromatic ring hydrocarbyl salicylate-carboxylate according to claim 18.

23. A method of producing a lubricating oil composition comprising blending the following components together.

(a) a major amount of a base oil of lubricating viscosity;

(b) from 1 to 30% of the overbased alkaline earth metal single-aromatic ring hydrocarbyl salicylate-carboxylate according to claim 18;

(c) from 0% to 20% of at least one ashless dispersant;

(d) from 0% to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

24. A lubricating oil composition produced by the method according to claim 23.

25. A hydraulic oil composition comprising a major portion of a base oil of lubricating viscosity and from 0.1% to 30% of the overbased alkaline earth metal single-aromatic ring hydrocarbyl salicylate-carboxylate according to claim 18.

26. A process for producing an overbased alkaline earth metal hydrocarbyl single-aromatic ring salicylate-carboxylate comprising:

(a) neutralizing hydrocarbyl phenols, which have been treated, before or during neutralization with a long-chain carboxylic acid, anhydride, or salt thereof, using an alkaline earth metal base in the presence of at least one carboxylic acid containing from one to four carbon atoms, and in the absence of alkali base, dialcohol, and monoalcohol, to produce an hydrocarbyl phenate-carboxylate wherein:

(1) said neutralization operation is carried out at a temperature of at least 200° C.;

(2) the pressure is reduced gradually below atmospheric in order to remove the water of reaction, in the absence of any solvent that may form an azeotrope with water;

(3) said hydrocarbyl phenols contain up to 85% of linear hydrocarbyl phenol in mixture with at least 15% of branched hydrocarbyl phenol in which the branched hydrocarbyl radical contains at least nine carbon atoms; and (4) the quantities of reagents used correspond to the following molar ratios:

(a) alkaline earth metal base/hydrocarbyl phenol of 0.2:1 to 0.7:1; and (b) carboxylic acid/hydrocarbyl phenol of from 0.01:1 to 0.5:1;

(a) carboxylating the hydrocarbyl phenate-carboxylate obtained in step (a) using carbon dioxide under carboxylation conditions sufficient to convert at least 20 mole % of the starting hydrocarbyl phenols to hydrocarbyl salicylate-carboxylate; and (b) contacting a mixture comprising the product of step (b), at least one solvent, metal hydroxide, and an alkyl polyhydric alcohol containing from one to five carbon atoms with carbon dioxide under overbasing reaction conditions.

27. A process for producing an overbased alkaline earth metal single-aromatic ring hydrocarbyl salicylate-carboxylate according to claim 26 wherein said hydrocarbyl phenols are alkylphenols and wherein said metal hydroxide is an alkaline earth metal hydroxide.

28. A process according to claim 27 wherein said alkaline earth metal hydroxide is calcium hydroxide, and wherein said alkyl polyhydric alcohol is ethylene glycol.

29. A process according to claim 27 wherein said mixture in step (c) further comprises an aqueous metal chloride.

30. A process according to claim 29 wherein said aqueous metal chloride is an aqueous calcium chloride.

* * * * *